US005108668A

United States Patent [19]

Kallup

[11] Patent Number: 5,108,668

[45] Date of Patent: Apr. 28, 1992

[54] PROCESS FOR MANUFACTURING DEVICE FOR CASTING LEAD GRIDS FOR ELECTRIC BATTERY PLATES

[75] Inventor: Bernhard E. Kallup, Aschaffenburg, Fed. Rep. of Germany

[73] Assignee: Varta Batterie Aktiengesellschaft, Hanover, Fed. Rep. of Germany

[21] Appl. No.: 895,878

[22] Filed: Aug. 12, 1986

[30] Foreign Application Priority Data

Aug. 20, 1985 [DE] Fed. Rep. of Germany ..... 3529725
Feb. 6, 1986 [DE] Fed. Rep. of Germany ..... 3603657

[51] Int. Cl.[5] ..... B06B 3/00; B28B 7/36; B28B 11/00; B29C 33/38

[52] U.S. Cl. ..... 264/23; 29/527.2; 156/153; 156/155; 164/17; 164/35; 164/46; 249/60; 264/39; 264/80; 264/118; 264/121; 264/125; 264/162; 264/163; 264/221; 264/296; 264/317; 264/337; 264/338

[58] Field of Search ..... 264/80, 219, 220, 221, 264/225-227, 23, 162, 293, 39, 42, 48, 118, 119, 121, 125, 139, 163, 296, 309, 337, 338, 317; 249/60; 164/46, 34, 35, 14, 17; 29/527.1, 527.2; 156/150, 153-155

[56] References Cited

U.S. PATENT DOCUMENTS

| | | | |
|---|---|---|---|
| 2,974,388 | 3/1961 | Ault | 264/221 |
| 3,228,650 | 1/1966 | Gilliland et al. | 264/225 |
| 3,494,997 | 2/1970 | Ditrich et al. | 264/225 |
| 3,638,299 | 2/1972 | Garner et al. | 164/46 |
| 3,673,293 | 6/1972 | Teague | 264/226 |
| 3,874,856 | 4/1975 | Leeds | 51/296 |
| 3,993,495 | 11/1976 | Gallliath et al. | 264/63 X |
| 4,088,046 | 5/1978 | Severinsson | 156/155 X |
| 4,093,017 | 6/1978 | Miller, Jr. et al. | 164/28 |
| 4,104,347 | 8/1978 | Ohashi et al. | 264/162 X |
| 4,120,930 | 10/1978 | Lemelson | 264/337 |
| 4,250,943 | 2/1981 | Rabinovitch et al. | 164/46 |
| 4,281,496 | 8/1981 | Danielsson | 264/162 X |
| 4,371,490 | 2/1983 | Geessink | 264/162 |
| 4,377,618 | 3/1981 | Ikeda et al. | 264/125 |
| 4,622,194 | 11/1986 | Rogers et al. | 264/162 |

FOREIGN PATENT DOCUMENTS

| | | | |
|---|---|---|---|
| 0065996 | 12/1982 | European Pat. Off. | 249/60 |
| 1280494 | 10/1968 | Fed. Rep. of Germany | 164/46 |
| 570953 | 7/1945 | United Kingdom | 164/349 |

*Primary Examiner*—Karen D. Kutach
*Attorney, Agent, or Firm*—Weiser & Stapler

[57] ABSTRACT

In connection with a device for casting lead grids for electric battery plates, a highly porous ceramic mold lining, preferably of zirconium oxide, is prepared by flame-spraying. Such a lining can include a thin surface coating on a profiled, basic metallic mold or a separately prepared insert plate which is retained to a metallic mold molder. The ceramic surface coating may be accurately formed in place, or may be formed as an over-spray which is then reduced in thickess. Formation of the surface coating may be accomplished by placing masks on the basic metallic mold during the flame spraying, for those areas of the grid which tend to accumulate material, or by adjusting an initially coarse profile of the ceramic layer to the exact profile of the casting by a material-removing treatment. Alternatively, the insert plate may be manufactured on a matrix with a surface contour which corresponds to the half-profile of the lead grid, as a positive mold to which the ceramic material is applied by flame-spraying after an intermediate coating with a removable adhesive layer. The resulting ceramic coating is then subjected to surface grinding, and is removed from the matrix.

12 Claims, 2 Drawing Sheets

PROCESS FOR MANUFACTURING DEVICE FOR CASTING LEAD GRIDS FOR ELECTRIC BATTERY PLATES

BACKGROUND OF THE INVENTION

The present invention relates generally to a process for casting lead grids for electric battery plates, and in particular, to an improved mold for use in casting such lead grids, and the corresponding manufacturing process.

Battery grids, especially those used in starter batteries, are often manufactured in two-part hinged casting molds which receive a molten lead flow (lead melt) either by gravity, or under pressure. To reduce adhesion of the lead melt to the mold (which is usually formed of cast iron), to permit air to escape from the mold cavity (particularly during gravity casting), and to counteract excessively rapid cooling of the lead melt, such molds (particularly those used for gravity casting) are conventially provided with a thin powder layer made of cork-flour or talc which is progressively consumed as the mold is used (generally after a life corresponding to, at most, 5000 castings). Consequently, this thin powder layer must eventually be renewed, and only after a time-consuming cleaning operation. In the case of die-casting, the molds are provided with a parting layer made, for example, of beef suet. This is performed before each casting.

A major improvement to this process is disclosed in EP-PS No. 65,996, which calls for the original metal casting mold to be lined with temperature-resistant ceramic molding plates. These plates are interchangeable, and are especially favorable for the fine, thin webs of starter grids because of the dimensional stability of the ceramic material.

However, practice has shown that due to its porosity, the conventional cork-flour layer is substantially more permeable to the air which is displaced by the casting process than are the known ceramic inserts. Additionally, due to the relatively low thermal insulation of known ceramic linings as compared to the coated (cork-flour layer) metal molds, practice has shown that heat is too rapidly dissipated from the lead melt, and that this heat dissipation is not sufficiently differentiated by the canals which are traditionally provided in the mold to receive a cooling medium.

SUMMARY OF THE INVENTION

It is, therefore, the primary object of the present invention to provide a casting mold which has the operative advantages of a ceramic material so that the mold is highly wear resistant during the casting of grids, yet which has a balanced rate of heat dissipation which is adjusted to the casting and solidification process so that the casting is easily removed from the mold, and in which displaced air is free to escape from the mold cavity.

It is also an object of the present invention to provide a casting mold which promotes uniform cooling of the lead melt, despite differences in material distribution.

These and other objects are accomplished according to the present invention by applying a ceramic material to the mold which has a high porosity, by flame-spraying. The solution according to the present invention is based upon the finding that contrary to electric or arc spraying, or plasma spraying, highly porous layers can be prepared by the flame-spraying of ceramic materials such as alumina, zirconium silicate, chromium oxide, or magnesium aluminate, but preferably zirconium oxide. Applied to the profiled grid-casting molds (made of metal), or designed as an insert, these layers are not only equivalent to cork-flour layers in terms of their "parting", "insulating", and "air guiding" functions, but also have the advantage of having a practically unlimited useful life in the production process. Thus, casting molds according to the present invention require practically no maintenance.

For further detail regarding preferred embodiment molds and processes for their manufacture according to the present invention, reference is made to the description which follows, taken in conjunction with the following illustrations.

BRIEF DESCRIPTION OF THE DRAWINGS

In the several views provided, like reference numerals denote similar structure.

DETAILED DESCRIPTION OF PREFERRED EMBODIMENTS

Figure 1:
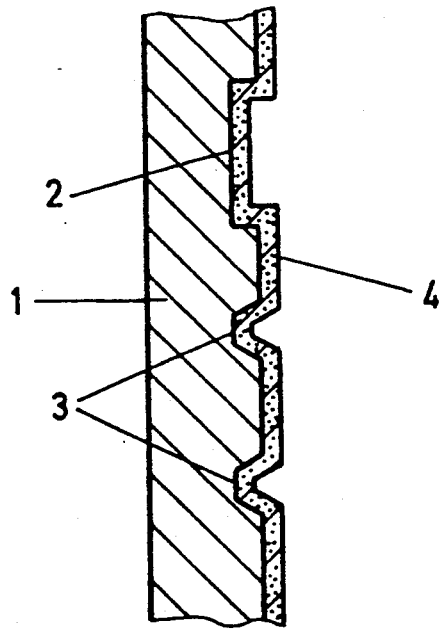
FIG. 1 is a partial, cross-sectional view which shows a surface-coated grid-casting mold according to the present invention.

FIG. 1 shows a casting mold 1 formed of a conventional metallic mold material and including engraved depressions 2, 3 which represent the negative molds (mold cavities) for the frame of the grid, at 2, and the web of the grid, at 3. The profiled side of the casting mold 1 is uniformly covered by a highly porous flame-sprayed ceramic layer 4, using ceramics such as alumina, zirconium silicate, chromium oxide, or magnesium aluminate, but preferably zirconium oxide, under appropriate conditions selected in accordance with generally recognized practices regarding the flame-spraying of ceramic materials.

The application of the coating material 4 to the profiled metal mold 1 by flame-spraying permits the layer's thickness to be differentiated over the entire mold cavity. In the areas 2 in which material tends to accumulate, such as the areas for the grid frame and the drain lugs, a relatively thin coating can be applied to provide relatively poor insulation in such areas. In the remaining areas, such as the areas 3 for the web of the grid, a relatively thick coating can be applied to provide for good insulation. Consequently, the rate of cooling for the areas which develop the web of the grid will correspond, in time, to the areas which develop the more massive parts of the grid.

The thickness of the ceramic layer may be dimensioned by means of masks which cover the corresponding parts of the basic metal mold, while leaving other areas accessible for the flame-spraying treatment. A covering effect can also be achieved by means of dry inserts in the casting mold. Due to its relatively poor insulating capacity, which is approximately half that of the other ceramic materials mentioned above, zirconium oxide leads to the desired effect according to the present invention, even if it is applied as a very thin layer.

Working with masks or other auxiliary means can be cumbersome in some cases. Consequently, a particularly advantageous solution which permits a melt with different degrees of material accumulation to cool at a practically identical rate over all areas, is to adjust the flame-sprayed ceramic layer to the exact contours of the casting by a mechanical, material-removing treatment. Treatment methods suitable for this purpose include grinding and ultrasonic erosion.

Such treatments have the effect that the areas which will exhibit good heat transmission are formed precisely in the areas of the ceramic layer which are to define the shapes of the larger material accumulations of the casting (e.g., grid frame and lug). This is due to the fact that the profiles which are to be removed from the ceramic layer in such regions leave behind a ceramic layer of reduced thickness due to their size and depth, so that the heat insulating effect of the resulting layer is reduced in proportion.

Conversely, there will be a corresponding reduction of the thickness of the layer of the ceramic material in the areas of the mold which will produce the fine contours of the casting. Undesirable, rapid heat dissipation from these areas of the melt which would lead to solidification of the grid webs sooner than the more massive parts of the electrode grid, is prevented by the insulating effect of the relatively thick-walled residual layer. This also avoids the risk of solidification of the thin parts of the casting before the melt has completely filled the fine cavities of the casting mold during the casting process, assuring that the remaining cavities are not prevented from being supplied with molten lead.

Adhesion of the ceramic layer 4 to the basic mold 1 can be improved by sand-blasting the basic mold prior to flame-spraying. In addition, priming with an alloy layer can be advantageous in increasing the thermal cycling capacity of the mold's wall material. This alloy layer may be comprised of an alloy based on chromium, cobalt, or nickel, for example, and can either be galvanically plated onto the basic metal mold, or applied by flame-spraying.

Instead of masking the basic mold during the flame-spraying of the ceramic material to prepare the different layer thicknesses as previously described, such a result can also be carried out during the sand-blasting procedure, and perhaps during the plating procedure, because the areas covered in this process remain relatively poor in terms of their wettability and are therefore less susceptible to the subsequent flame-spraying treatment than are their surroundings. Coating in these areas is only possible if they are properly prepared following sand-blasting.

Flame-spraying according to the present invention also permits separate coating of the mold and its various inserts (e.g., the vent bars), whereupon these components may be assembled after their respective coatings have been applied. It is thus possible to carefully maintain the vent gap between the mold and the vent bars to avoid deterioration of the operation of the vent systems. Such vent holes may also be provided by subsequent drilling, or by removable pin inserts which are appropriately positioned prior to coating, since such structures are not wet by the ceramic layer.

Figure 2:
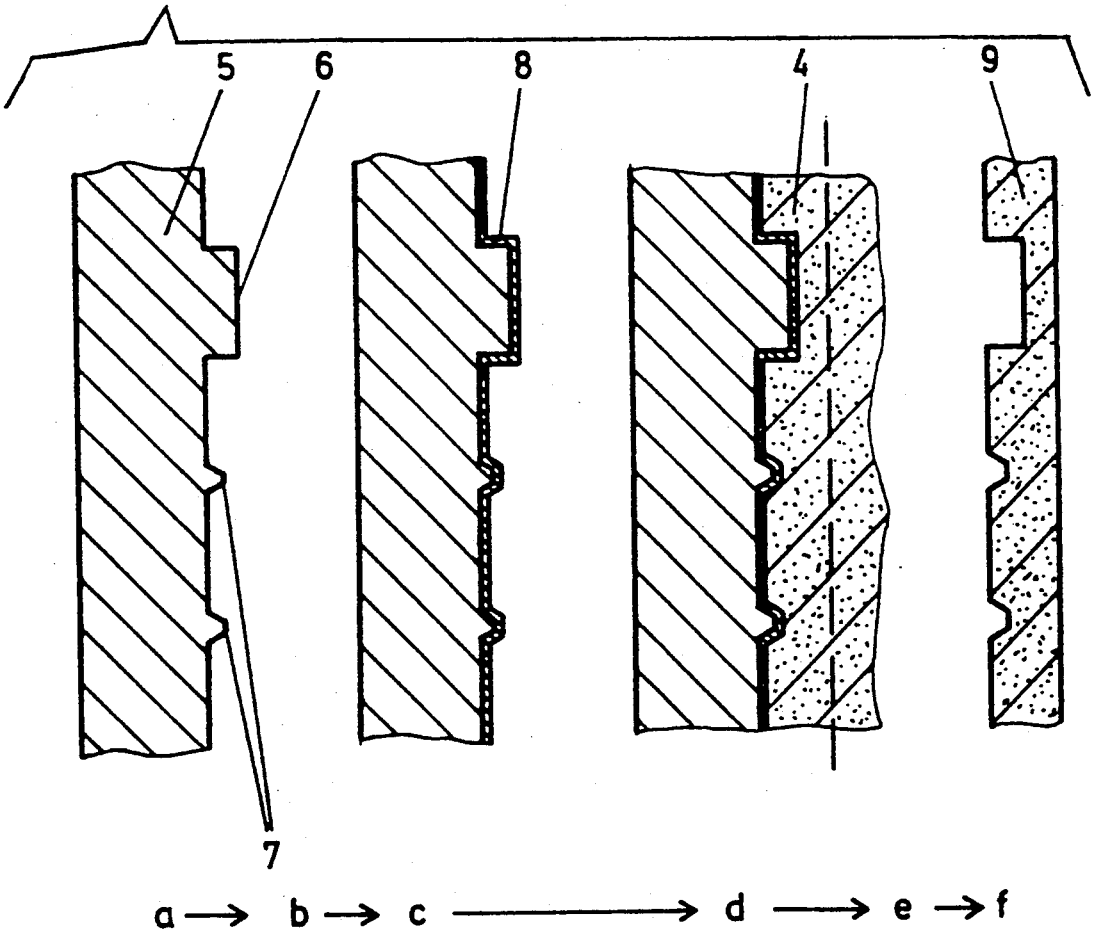
FIG. 2 is a series of partial, cross-sectional views which schematically show a process for manufacturing an insert for a metallic mold carrier according to the present invention.

FIG. 2 shows an alternative process for providing a mold for casting grids according to the present invention, making use of the selected ceramic material to itself form a complete casting mold which may be used as an insert retained in a metallic holder.

The process begins (step a) with the preparation of a metal matrix 5 which serves as a positive mold having a surface contour which represents the grid frame 6 and the grid webs 7, and which corresponds to a half-profile of the lead grid to be cast. The matrix is sand-blasted (step b) and coated (step c) with a thin adhesive layer 8 made of an alloy having a low melting point, or a chemically readily soluble material, as a preparation for the ceramic coating. This can again be carried out by flame-spraying, or electroplating. The insert part is formed (step d) by applying the ceramic layer 4 by the flame-spraying process. The thickness of the applied layer must substantially exceed the profile depth of the lead grid so that a mechanically stable, highly porous insert plate 9 is obtained after finishing (step f) by equalizing the surface by grinding to a desired thickness (broken line). Lastly, the insert plate 9 is separated (step e) from the matrix 5 (e.g., by melting the alloy 8). The resulting insert plate 9, which serves as a negative mold, represents an insert according to the present invention which can be held in place by a metallic support plate (not shown). Such metallic support plates are conventionally fitted with heating and cooling systems, as well as mold vent systems, and are incorporated in the mold holders of the casting machines.

The metallic base mold 1 of FIG. 1, and the metallic matrix 5 of FIG. 2, each called for an exactly worked surface profile which was then overfit with a conforming ceramic coating. However, other molds may be developed in accordance with the present invention which are based on a roughly contoured base material, as follows.

Figure 3:
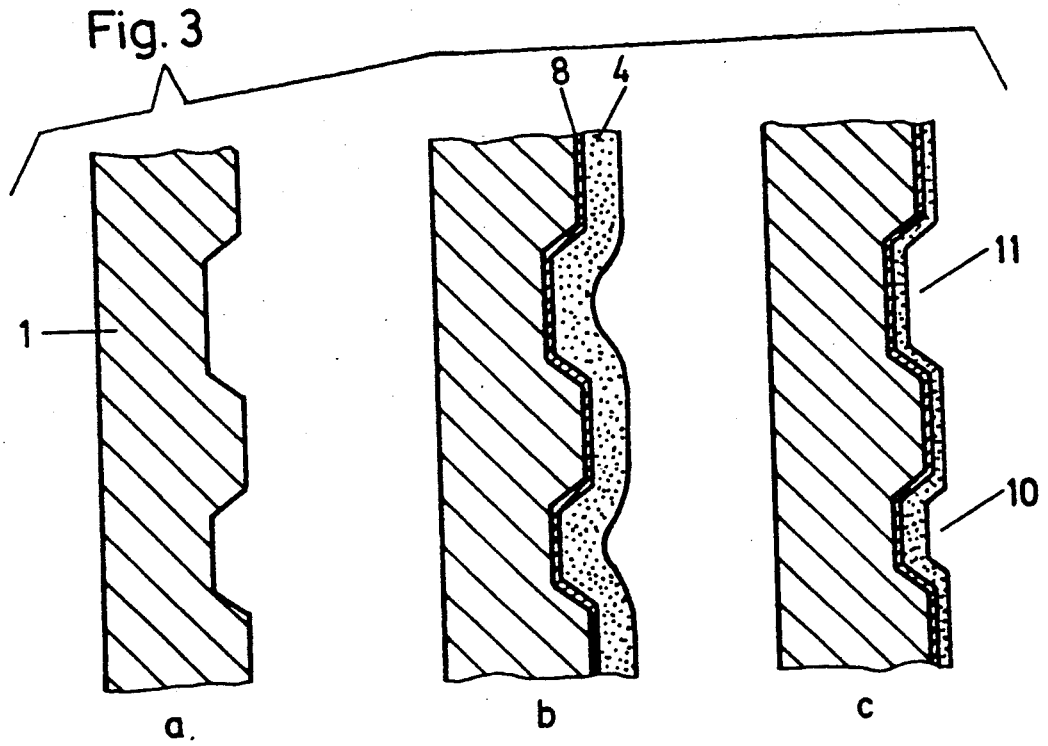
FIG. 3 similarly shows a process for manufacturing a flame-sprayed ceramic grid-casting mold according to the present invention.

FIG. 3 shows a mold carrier 1 which is made, for example, of cast iron, and which serves as the base material of a two-part, hinged casting mold. The mold carrier 1 has a rough (approximated) negative profile of the casting to be developed, and serves as a substrate for receiving a ceramic coating 4 (step a). Prior to receiving the ceramic coating 4, the mold carrier 1 is provided with a thin adhesion-improving layer 8 which is preferably based on a sand-blasted surface. The mold carrier 1 is then coated with the ceramic material 4, preferably zirconium oxide, by flame-spraying (step b). To be noted is that the original surface profile of the mold carrier 1 is practically completely effaced due to the application of the ceramic layer 4. The resulting impressions are then trimmed to the exact dimensions desired by a suitable mechanical treatment, preferably grinding (step c). As a consequence of this treatment, the residual ceramic coating which is left under the relatively thin grid-web profile 10 is substantially greater in thickness than the residual layer which is left under the relatively large incision 11 in the profile (e.g., for the grid frame). Consequently, the relatively thin web is better protected from cooling during the casting process.

Figure 4:
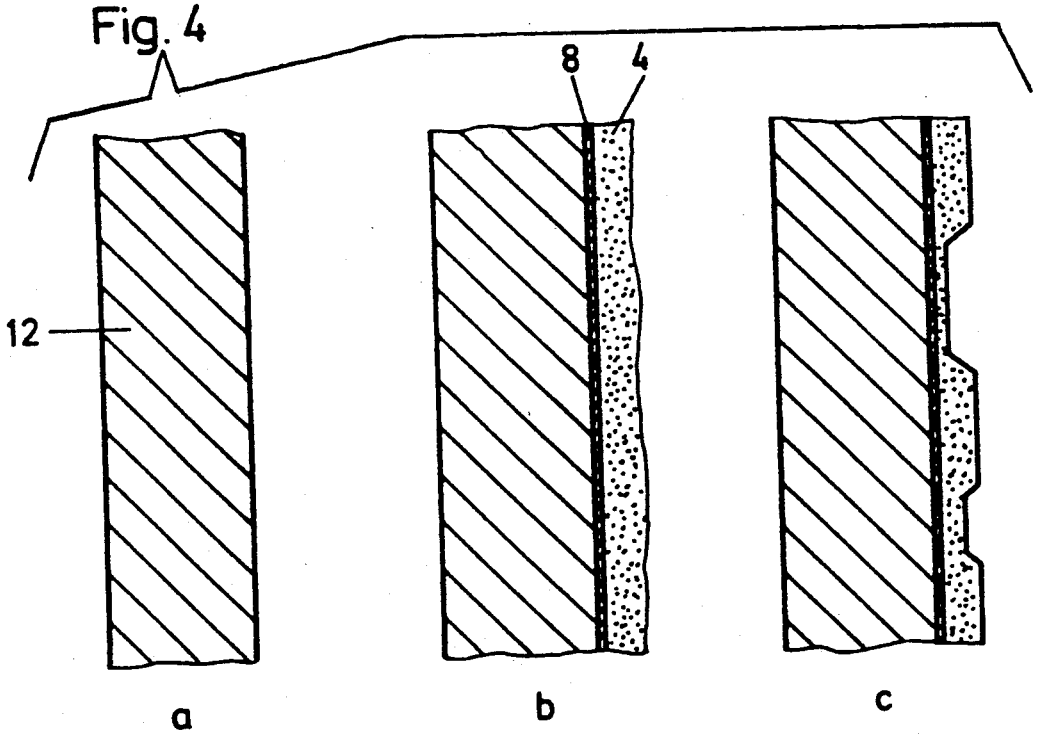
FIG. 4 similarly shows a modified manufacturing process which is based on a flat mold.

FIG. 4 shows a process in which the ceramic casting mold is manufactured on a basic mold carrier 12 having a flat surface (step a). The ceramic layer 4 which is subsequently applied by flame-spraying (bonded by the adhesive layer 8) is consequently relatively flat and uniform in thickness (step b). The negative mold for the casting is then exactly modeled within this layer, again preferably by grinding (step c). Consequently, as is apparent from the figure, a casting mold is obtained with a wall-thickness distribution which will ensure a solution to the problem of differentiated heat dissipation in proportion to the melt distribution.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A process for manufacturing a device for casting lead grids for electric battery plates from a lead melt, which device is formed of a ceramic material having a surface which defines a mold for a grid casting and which is in direct contact with the melt which flows into the mold, comprising the steps of:

providing a profiled, basic metallic mold for receiving the ceramic material;

sand-blasting the profiled, basic metallic mold;

plating the sand-blasted, profiled, basic metallic mold by flame-spraying with a layer comprised of an alloy selected from the group consisting of chromium, cobalt and nickel, prior to application of the ceramic material, to improve adhesion of the ceramic material; and applying the ceramic material to the plated, profiled, basic metallic mold by flame-spraying, thereby forming the ceramic surface of a highly porous ceramic material.

2. The process of claim 1 wherein the ceramic material is selected from the group consisting of alumina, zirconium silicate, chromium oxide, magnesium aluminate, and zirconium oxide.

3. The process of claim 1 wherein the flame-sprayed ceramic material is adjusted to the contours of the grid casting by mechanically removing material from the ceramic surface.

4. The process of claim 3 wherein the mechanical removal is by grinding or ultrasonic erosion.

5. The process of claim 1 wherein the ceramic surface is formed to achieve different thickness distributions of the ceramic material.

6. The process of claim 5 wherein the ceramic material has a first thickness in a first area of the grid casting which exceeds a second thickness in a second area of the grid casting, so that heat dissipation from said second area is more rapid than heat dissipation from said first area.

7. The process of claim 6 wherein the ceramic material is only roughly applied to the profiled, basic metallic mold, and wherein the ceramic material is adjusted to the contours of the grid casting by mechanically removing portions of the ceramic material.

8. The process of claim 6 wherein the first area defines a grid web, and the second area defines a grid frame and lug.

9. The process of claim 8 wherein the surface of the profiled, basic metallic mold is covered by masks in the second area of the mold during the flame-spraying of the ceramic material.

10. The process of claim 8 wherein the surface of the profiled, basic metallic mold is covered by masks in the second area of the mold during the sand-blasting and plating.

11. The process for manufacturing a device for casting lead grids for electric battery plates from a lead melt, which device is formed of a ceramic material having a surface which defines a mold for a grid casting and which is in direct contact with the melt which flows into the mold, comprising the steps of:

providing a metal matrix having a surface contour which corresponds to the half-profile of the lead grid to be cast;

providing the surface of the metal matrix with an adhesive layer formed of an alloy having a low melting point or a chemically readily soluble material by flame-spraying or galvanic separation;

applying the ceramic material on the adhesive layer, thereby forming the ceramic surface of a highly porous ceramic material by flame-spraying in a layer having a thickness which substantially exceeds the profile depth of the lead grid;

smoothing the exposed surface of the ceramic layer by surface grinding; and separating the ceramic layer from the matrix as an integral part, while removing adhering residues of the adhesive layer.

12. The process of claim 11 wherein the surface of the metal matrix is sand-blasted before receiving the adhesive layer.

* * * * *